United States Patent [19]

Chabot

[11] Patent Number: 4,593,610

[45] Date of Patent: Jun. 10, 1986

[54] AUTOMATIC DAMPER FOR CHIMNEY FLUE

[76] Inventor: Paul-André Chabot, 736 Baker St., Vanier, Canada, G1M 2T9

[21] Appl. No.: 708,151

[22] Filed: Mar. 4, 1985

[51] Int. Cl.[4] ..... F23L 17/02

[52] U.S. Cl. ..... 98/74; 98/71; 98/73

[58] Field of Search ..... 98/68–74; 126/286

[56] References Cited

U.S. PATENT DOCUMENTS

| | | | |
|---|---|---|---|
| 344,565 | 6/1886 | Clifford | 98/71 |
| 1,256,917 | 2/1918 | MacWilliams | 98/68 |

FOREIGN PATENT DOCUMENTS

| | | | |
|---|---|---|---|
| 104388 | 6/1907 | Canada | 98/73 |
| 121754 | 11/1909 | Canada | 98/73 |
| 142745 | 9/1912 | Canada | 98/73 |
| 156482 | 6/1914 | Canada | 98/73 |
| 159552 | 12/1914 | Canada | 98/73 |
| 199978 | 5/1920 | Canada | 98/73 |
| 1134116 | 10/1982 | Canada | 98/73 |
| 684903 | 11/1939 | Fed. Rep. of Germany | 98/71 |
| 24380 | 10/1931 | United Kingdom | 98/68 |
| 17131 | 9/1985 | United Kingdom | 98/73 |

*Primary Examiner*—James C. Yeung

[57] ABSTRACT

There is disclosed an automatic damper for a chimney flue, which maintains the chimney draft at an adjusted value despite varying wind velocity and direction. A vertical shaft is rotatably supported over the top outlet of the flue by a support secured to the chimney. A weather cock is secured to the upper end of the vertical shaft and a transverse horizontal pivot rod is fixed intermediate its ends to the lower end of the vertical shaft at the level of the top of the flue outlet. A damper flap is pivoted at its mid-section on the pivot rod, defining two sections on either side of the pivot rod. A weight is secured to one section, so as to normally keep the flap in vertical position to fully open the flue, with the other flap section protruding upwardly from the chimney and exposed to the wind. Increasing wind velocity on the exposed flap section causes progressive closing of the flue to counteract the otherwise-increased draft produced by the increasing wind velocity. The system saves on fuel consumption. The weather cock keeps the flap facing the wind irrespective of the wind direction.

4 Claims, 6 Drawing Figures

44
48
46
36
38
30
24
34
40
42
28
32
18
12
24
6
34
50
52
66
68
36
60
58
70
56
64
71
30
24
26
16

AUTOMATIC DAMPER FOR CHIMNEY FLUE

FIELD OF THE INVENTION

This invention relates to an automatic damper for a chimney flue, so as to keep constant the chimney draft despite varying wind and velocity and direction.

BACKGROUND OF THE INVENTION

Canadian Pat. No. 159,552 dated Dec. 15, 1914, in the name of John Gorrien, describes an automatic damper of the above-noted type and for the same purpose. Because of its construction, the damper arrangement of this patent cannot produce an equal closing of the damper for all wind direction and, therefore, the chimney draft cannot be kept sufficiently constant, not only under varying wind velocities but also under varying wind directions.

OBJECTS OF THE INVENTION

The main object of the present invention is therefore to provide an automatic chimney flue damper which will keep the chimney draft at a substantially constant value, in spite of not only varying wind velocities but also in spite of varying wind directions.

Another object of the present invention is to provide an automatic damper for a chimney flue which is of simple and inexpensive construction; which can be easily fitted to an existing chimney; and which has a long working life despite its exposure to flue gases.

SUMMARY OF THE INVENTION

The automatic damper for a chimney flue in accordance with the invention comprises, as installed on a flue, a support, means to secure the support to the flue with the support having a portion extending over the top outlet of said flue, a vertical shaft rotatably carried by said support about said top outlet and extending downwardly towards said flue, a weather cock fixed to the upper end of said shaft and exposed to the wind, a transverse generally horizontal pivot rod fixed to the lower end of said shaft and disposed at the level of said outlet, a damper flap for partially closing said chimney flue, pivotally carried by said pivot rod about its mid-section and defining an outer section and an inner section on opposite sides of said pivot rod, and a weight carried by said inner section and biasing said flap to a generally flue-opening position in which said outer section protrudes upwardly from said outlet and is exposed to the wind, whereby increasing wind velocity acting on said outer flap section will cause pivoting of said flap to a progressively horizontal position progressively closing said flue against the bias of said weight, said weather cock keeping said pivot rod transverse to said wind direction. Preferably, means are provided to secure the weight to an adjustable distance from the pivot rod, so as to change the amount of the desired chimney draft for a given value of the wind velocity. Preferably, the flap is flat over its major portion and curved at the marginal portion of its outer section, which is most distant from said pivot rod, with said curved portion defining a concave surface facing the wind direction, so as to increase the damper-closing action of the wind. Preferably also, the damper flap includes an abutment finger which abuts against the pivot shaft when the flap has attained a generally horizontal position, so as to prevent overturning of the flap about its pivot shaft. Preferably also, the outer section of the flap has a radial slit extending from the pivot rod to the outer edge of the flap for freely receiving the rod shaft, so that the flap can freely assume its vertical flue-opening position.

DETAILED DESCRIPTION OF THE INVENTION

Figure 1:
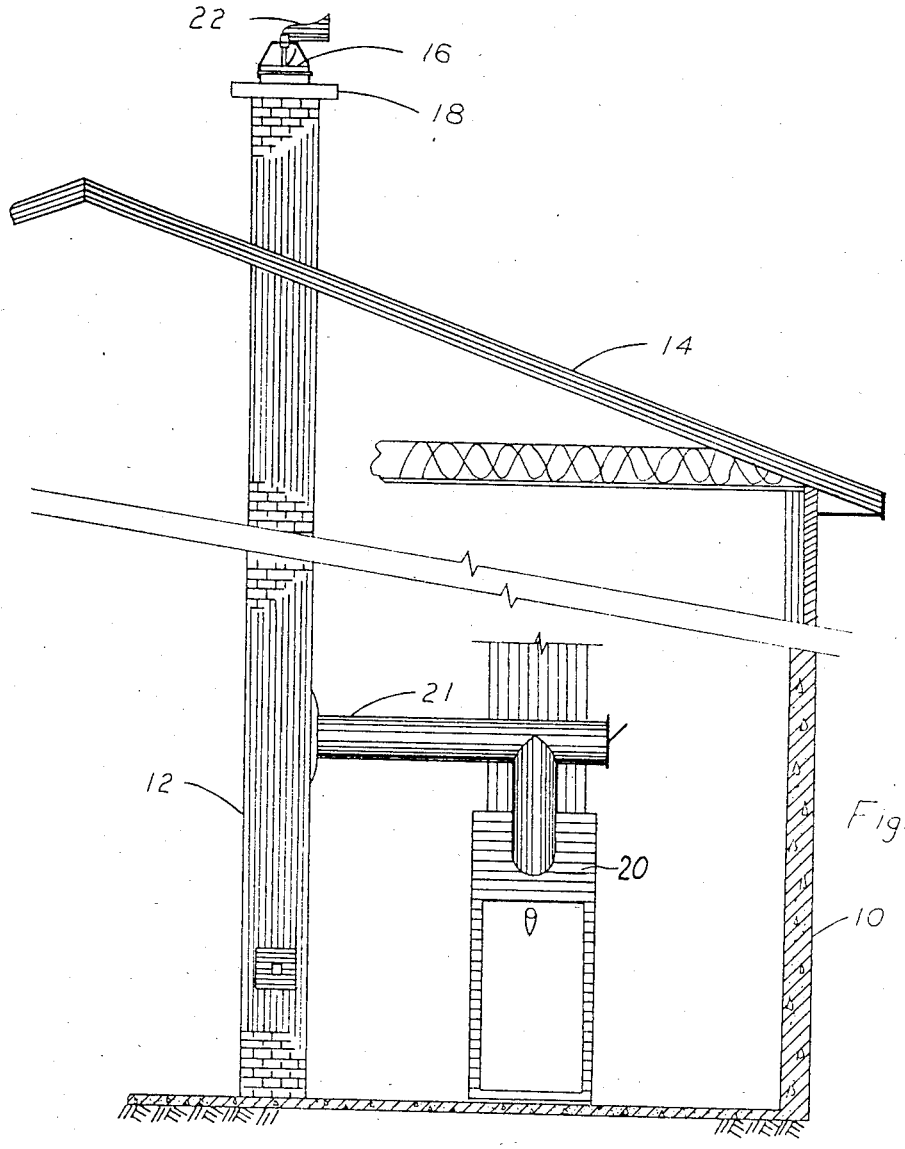
FIG. 1 is a sectional elevation of part of a house showing the chimney thereof, the top of the chimney being provided with the automatic damper in accordance with the invention.
Figure 2:
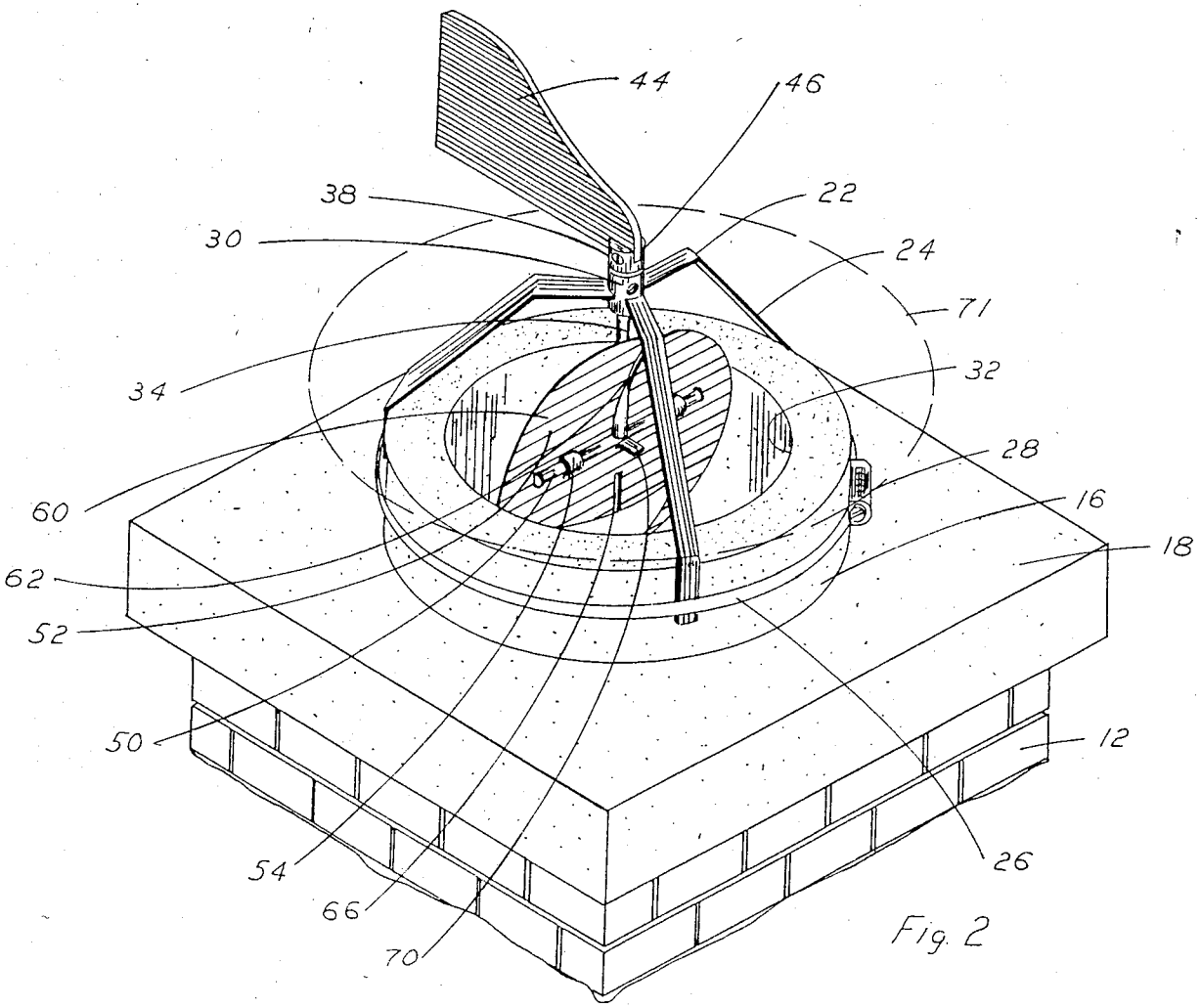
FIG. 2 is a perspective view of the top of the chimney with the automatic damper of the invention installed on the same.
Figure 3:
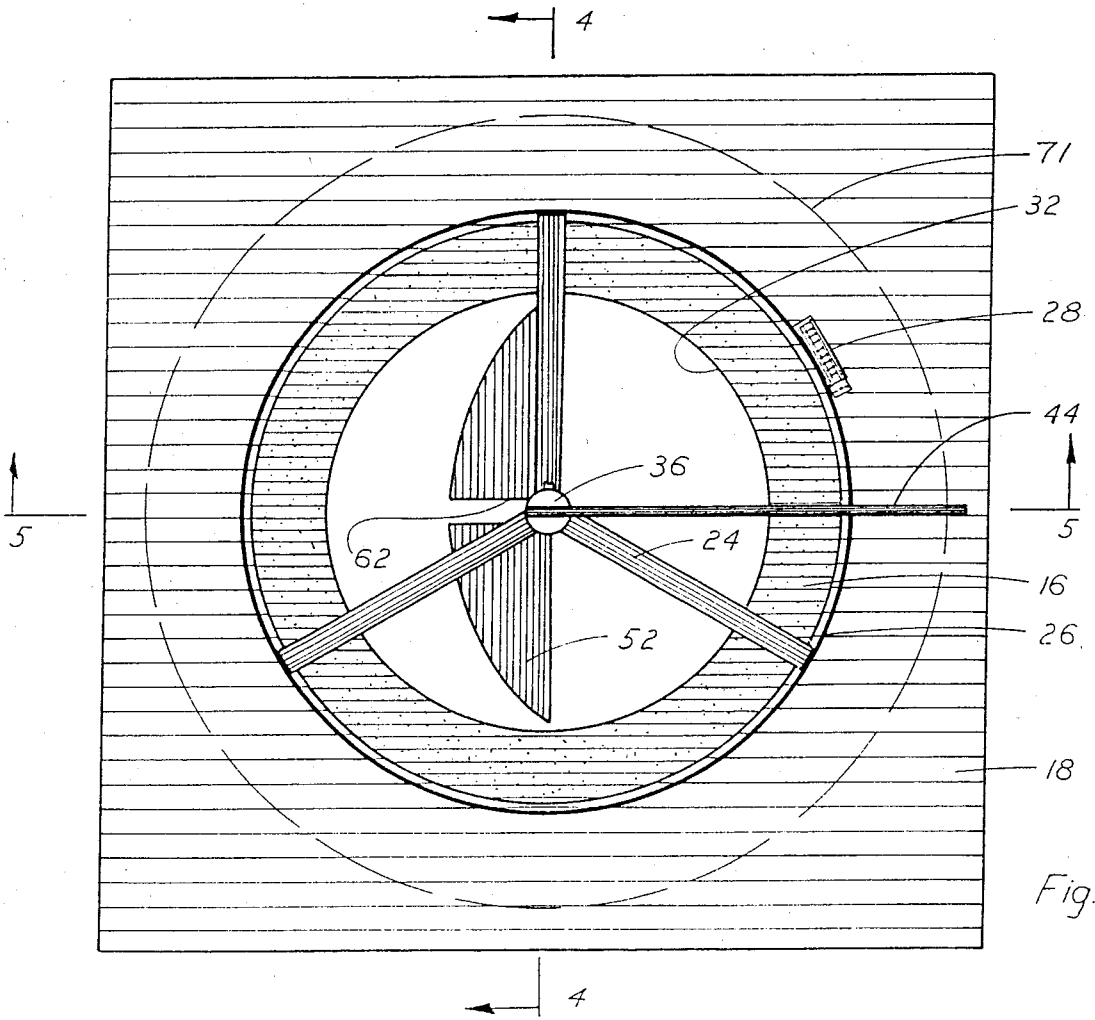
FIG. 3 is a top plan view of the chimney top and automatic damper.
Figure 4:
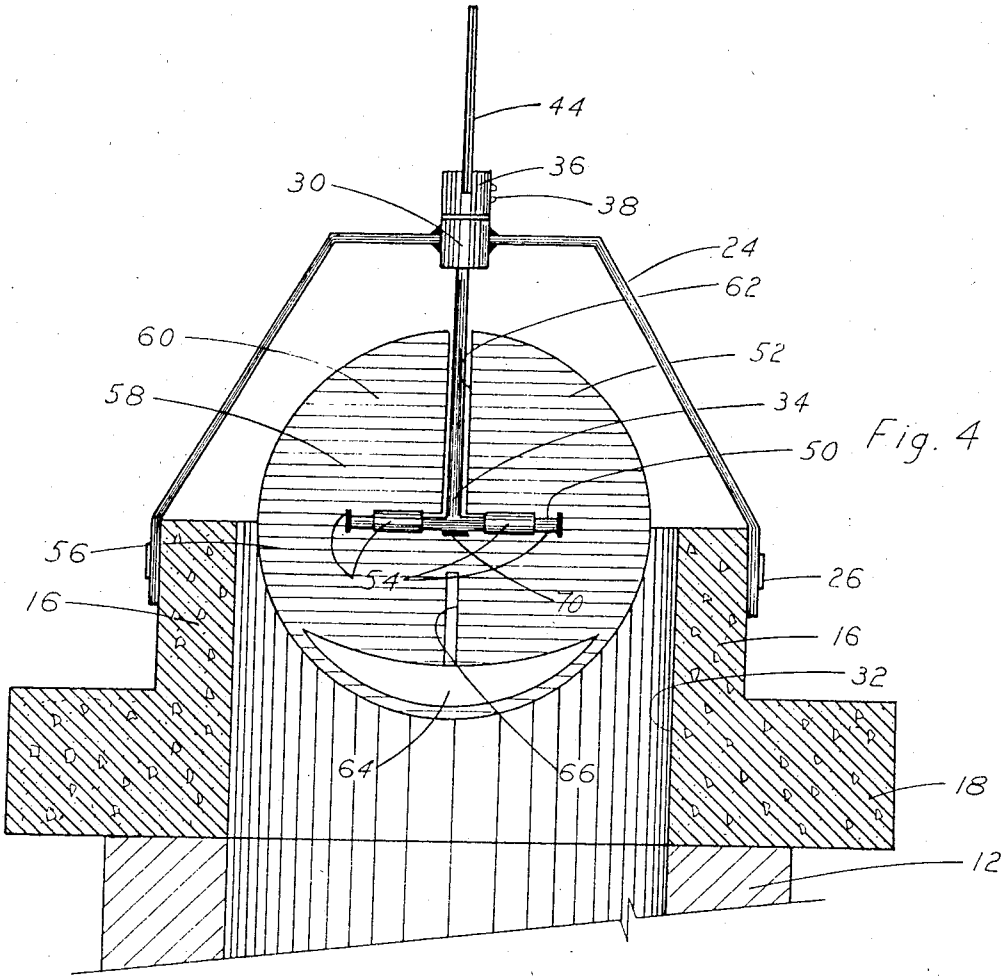
FIG. 4 is a vertical section taken along line 4—4 of FIG. 3.
Figures 5, 6:
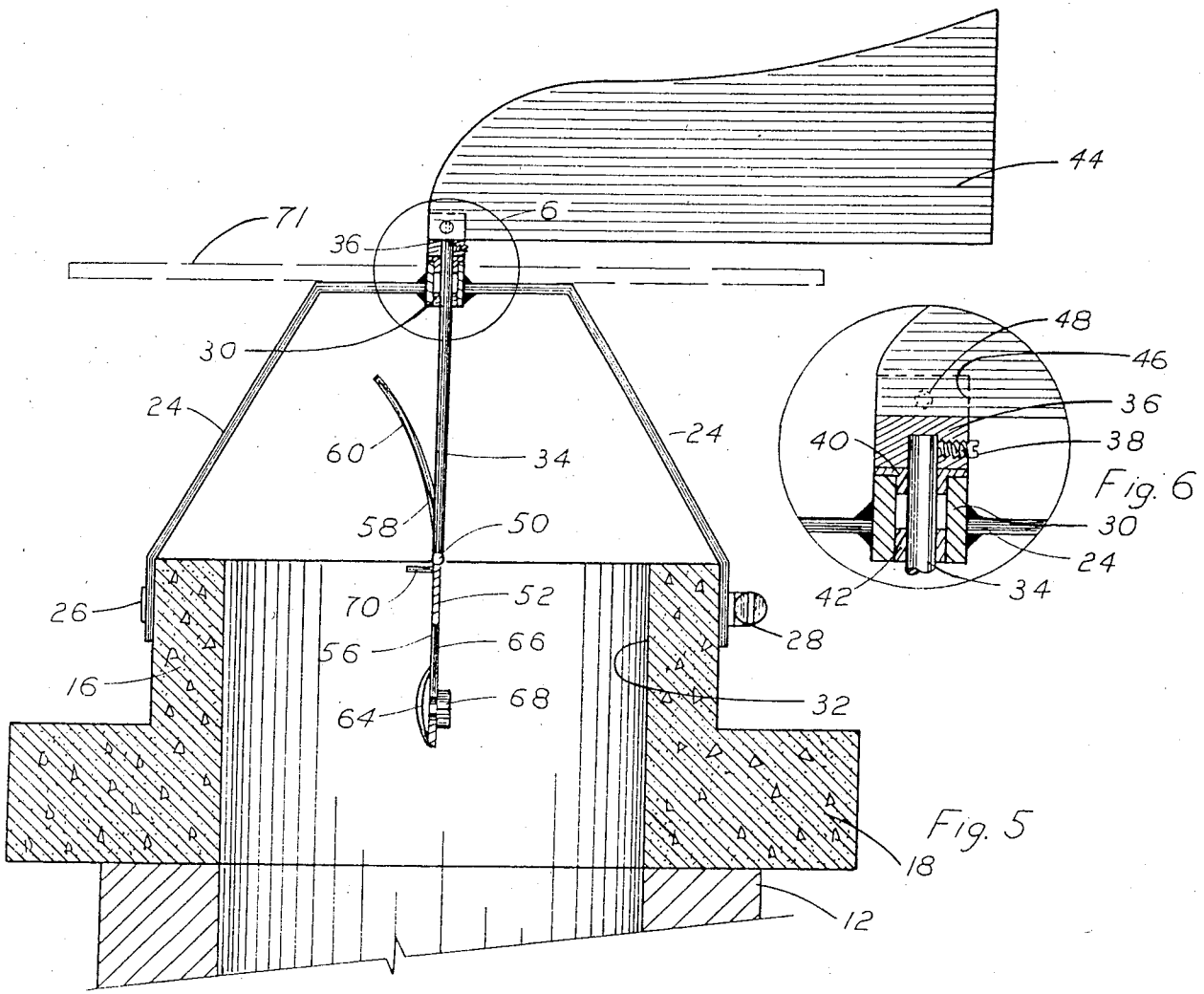
FIG. 5 is a vertical section taken along line 5—5 of FIG. 3.
FIG. 6 is a vertical section on an enlarged scale of the pivotal arrangement of the vertical shaft and taken within circle 6 of FIG. 5.

FIG. 1 shows a house 10 provided with a conventional chimney 12 protruding through the roof 14 and terminated by a chimney top 16 serving as a flue outlet, said chimney top 16 protruding upwardly from a chimney-protecting cap 18, of conventional construction. For instance, the chimney serves for the escape of the flue gases of a heating unit 20 producing combustion gases which escape through the duct 21 and through the chimney 12. The automatic chimney damper unit in accordance with the invention is mounted on the chimney top 16 and is generally indicated at 22. This unit 22 comprises a support 24 which preferably consists of a tripod, the lower end of the three legs of which is fixed to the outer surface of chimney top 16 by a metal strap 26 tightened by a conventional screw-actuated tightener 28. The upper ends of the three legs of the tripod support 24 are fixed to and extend radially from a central sleeve 30, which is thus supported over and co-axial with the cylindrical flue 32 of the chimney 12. The upper end of a vertical pivot shaft 34 is supported by and is rotatably mounted within the central sleeve 30. More particularly, as shown in FIG. 6, a cylindrical block 36 is fixed to the top end of the pivot shaft 34 by means of a setscrew 38; said block rests on a cap bushing 40 which extends between the sleeve 32 and the pivot shaft 34. Another guiding bushing 42 also surrounds the shaft 34 within sleeve 30. A weather vane or weather cock 44, arranged in a vertical plane, is fixed at one end to the block 36 by being inserted at its lower front corner within a top slot 46 made in said block 36 and screwed in position by means of a screw 48. The pivot shaft 34 extends downwardly co-axial with the chimney flue down to the level of the flue exit of the chimney top 16. A transverse horizontally-extending rod 50 is secured at its midsection to the lower end of shaft 34. A damper flap 52, in the form of a disc of a diameter slightly smaller than that of the cylindrical flue 32, is rotatably mounted on the transverse rod 50 with the center of said flap substantially coincident with the longitudinal axis of pivot shaft 34. The damper flap is pivotally retained on the transverse rod 50 by means of a pair of curved cut-out tabs 54 integral with the sheet metal flap 52 and conforming and surrounding the rod 50. Cut-out end tabs 54 of flap 52 abut the ends of rod 50 to prevent transverse movement of flap 52 on rod 50. The flap 52 is defined by an inner section 56 and an outer section 58 disposed on opposite sides of pivot rod 50. The flap 52 can take a generally vertical position, fully opening the chimney flue and in which the outer section 58 protrudes upwardly from the chimney outlet of top 16 and is exposed to the wind. The top marginal portion 60 of the outer section 58, which is most distant from the transverse rod 50, is curved, when seen in cross-section, so as to define a concave surface which faces in the wind direction. In order to permit the flap 52 to take a vertical position despite the presence of the curved marginal portion 60, the outer section 58 is provided with a radial slit 62 which extends from transverse rod 50 towards the outer edge of the curved marginal portion 60 at the middle thereof, so as to freely receive the pivot shaft 34. A weight 64 is secured to the inner section 56, so as to normally bias the damper flap 52 to a generally vertical position, fully opening the chimney flue. This weight 64 is preferably radially adjustable on the flap 52. For this purpose, a radial slot 66 is made in the inner section 56 of the flap 52 and the weight 64 is adjustably fixed to the flap by a bolt 68 which can slide within slot 66 and is tightly screwed within the weight 64, as shown in FIG. 5. A stop finger 70 is cut out from the center of the flap 52 and extends at right angle thereto and its free end is adapted to abut the vertical shaft 34 when the flap 52 reaches a substantially-horizontal position, in which it nearly completely closes the chimney flue, an annular gap being left between the flap 52 and the chimney flue. Stop finger 70 prevents overturning of the flap 52 about the pivot rod 50. The weather cock 44 is set on the pivot shaft 34, so as to be at right angle to the transverse rod 50 and such as to extend in a direction away from the front wind-facing concave surface of the flap 52. Weather cock 44 therefore pivots the shaft 34, so as to always maintain the front concave surface of the flap 52 facing in the wind direction. Increasing wind velocity acting on the outer exposed section 58 of the flap 52 gradually causes closing of the chimney flue, thereby keeping the chimney draft constant despite increasing wind velocity. This action is independent of the wind direction, since the flap 52 is always kept transverse to the same. The chimney draft can be adjusted to the desired value by adjustably securing the weight 64 on the flap 52. For instance, it might be desirable to increase the chimney draft in order to increase the ventilation of the house 10 in case this house is very much air-tight.

A plate, or disc 71, can be secured to sleeve 30 in horizontal position over the chimney to protect the latter against rain or snow.

What I claim is:

1. An automatic damper for controlling the draft of a chimney flue, having a cylindrical top outlet portion, said damper, as installed on said flue, comprising a support, means securing said support to said flue, said support having a portion extending over said top outlet portion, said support consisting of an open frame to form minimum obstruction to the wind, a shaft rotatably carried by said support above said top outlet portion, extending downwardly towards said flue and substantially co-axial therewith, a weather cock fixed to the upper end of said shaft, exposed to the wind and rotating said shaft upon a change in the wind direction, a transverse generally horizontal rod fixed at its midsection to the lower end of said shaft and disposed at the level of said top outlet portion, a circular damper flap for partially closing said chimney flue, having a smaller diameter than that of said top outlet portion and pivotally carried by said transverse rod, with the center of said flap substantially coincident with the axis of said shaft, said flap defining an outer flap section and an inner flap section on opposite sides of said transverse rod, and a weight carried by said flap inner section and biasing said flap to a generally vertical position, opening said flue, and in which said outer flap section protrudes upwardly from said top outlet portion and is exposed to the wind, increasing wind velocity acting on said outer flap section causing pivoting of said flap to a progressively-horizontal position progressively closing said flue against the bias of said weight, said weather cock keeping said transverse rod in a position transverse to said wind direction, an annular gap being left between said top outlet portion and said flap when the latter reaches said substantially-horizontal position, the damper maintaining the draft in the chimney flue at an adjusted value despite varying wind velocity and wind direction.

2. An automatic damper as defined in claim 1, further including means to secure said weight to said inner flap section at an adjustable distance from said transverse rod.

3. An automatic damper as defined in claim 1, wherein said flap is substantially flat over its major portion and is curved at the marginal portion of said outer section, which is most distant from said transverse rod, said curved portion defining a concave surface facing the wind direction, and said inner flap section having a slit extending from said transverse rod and opening at the edge of said curved marginal portion for freely receiving said shaft when said flap is in generally vertical position.

4. An automatic damper as defined in claim 3, further including a stop finger carried by said flap and abutting said shaft when said flap is in a generally horizontal position.

* * * * *